US008683624B1

(12) United States Patent
Zhadanov et al.

(10) Patent No.: US 8,683,624 B1
(45) Date of Patent: Apr. 1, 2014

(54) SYSTEM FOR SHOWERING

(71) Applicants: Eli Zhadanov, Brooklyn, NY (US); Sam Zhadanov, Brooklyn, NY (US)

(72) Inventors: Eli Zhadanov, Brooklyn, NY (US); Sam Zhadanov, Brooklyn, NY (US)

( * ) Notice: Subject to any disclaimer, the term of this patent is extended or adjusted under 35 U.S.C. 154(b) by 0 days.

(21) Appl. No.: 13/690,022

(22) Filed: Nov. 30, 2012

(51) Int. Cl.
*A47K 3/00* (2006.01)

(52) U.S. Cl.
USPC ..... 4/615

(58) Field of Classification Search
USPC ..... 4/615, 675, 567, 570
See application file for complete search history.

(56) References Cited

U.S. PATENT DOCUMENTS

| | | | | |
|---|---|---|---|---|
| 3,121,235 | A * | 2/1964 | Gellmann | 4/570 |
| D450,370 | S * | 11/2001 | Wales et al. | D23/213 |
| 7,043,776 | B1 * | 5/2006 | Wu | 4/601 |
| D531,259 | S * | 10/2006 | Hsieh | D23/213 |
| 7,458,112 | B1 * | 12/2008 | Yang | 4/601 |
| 2009/0265848 | A1 * | 10/2009 | Tsai | 4/615 |

* cited by examiner

*Primary Examiner* — Huyen Le
(74) *Attorney, Agent, or Firm* — Henry M. Feiereisen, LLC

(57) ABSTRACT

A system for showering includes a showerhead and a water conveying device having two water conveying members turnable relative to one another about a turning axis and having openings for water entry and exit formed so that in an assembled position of the conveying members the openings of the conveying members extend transversely to the turning axis and are coaxial with one another.

9 Claims, 10 Drawing Sheets

SYSTEM FOR SHOWERING

BACKGROUND OF THE INVENTION

The present invention generally relates to systems for showering.

Systems for showering are known in the art. The known systems usually include a showerhead which can be used as an overhead showerhead and connected to a water supplying pipe, or a hand-held shower having a showerhead mounted on a handle connected to a water supplying pipe, or various combinations of the above mentioned showerheads. In systems for showering it is important to provide various orientations and adjustable locations of the showerheads to achieve a comfort for washing various parts of a user's body for users having different height, age, physical abilities, etc.

It is believed that the existing systems for showering can be further improved to achieve the above mentioned results.

SUMMARY OF THE INVENTION

Accordingly, it is an object of the present invention to provide a system for showering, which is a further improvement of existing showering systems.

In keeping with these objects and with others which will become apparent hereinafter, one feature of the present invention resides, briefly stated, in a system for showering, comprising at least one showerhead, and a water conveying device configured to connect said showerhead to a water supplying pipe, wherein said water conveying device includes first and second water conveying members provided with first and second member connecting means and assembled with each other so that they are turnable relative to one another about a turning axis between a plurality of angular positions relative to one another, wherein said first water conveying member has a first opening for water entry and said second water conveying member has a second opening for water exit formed so that in an assembled position of said first and second water conveying members said first and said second openings of said first and second water conveying members extend transversely to said turning axis and are coaxial with each other.

When the system for showering is designed in accordance with the present invention it allows to arrange the components of the system in a desired order, at a desired location, and at a convenient height for particular users. Units which are connected by the device are coaxial and do not have a side offset relative to one another.

In accordance with another feature of the present invention, fixing means are provided in the inventive system of showering and configured so that they hold the first and second water conveying members with one another, lock them in any of a plurality of angular positions relative to one another and compress the seals between the components of the inventive system of showering to provide a leak-free operation.

A further feature of the present invention resides in that one of said water conveying members is connectable by one of said connecting means to a water supplying pipe, while the other of said water connecting members is connected with said showerhead so that said showerhead can turn relative to the water supplying pipe.

A further feature of the inventive showering system it that it also comprises an elongated extension arm having two opposite ends, and a second such water conveying device, wherein one end of said elongated connecting arm is turnably connectable by one of said water conveying devices to the water supplying pipe, while the other end of said elongated arm is turnably connected by-the other of said water conveying devices to said shower head.

Still a further feature of the present invention is that it can also comprise a handshower, a water distributing unit for distributing water to said showerhead and to said handshower, a second such water conveying device, and an elongated arm having two opposite ends, wherein said water distributing unit has an inlet connectable to the water supplying pipe, a first outlet connected to said handshower, and a second outlet, wherein one of said water conveying devices turnably connects said showerhead to one end of said elongated arm, while the other water conveying device turnably connects the other end of said elongated arm to said second outlet of said water distributing unit.

A further feature of the inventive system for showering is that it can also have a handshower, a distributing unit for distributing water to said showerhead or to said handshower, an elongated extension pipe having two opposite ends and a second such water conveying device, wherein one of said water conveying devices is arranged to turnably connect the water supplying pipe to one end of said extension pipe, the other end of said extension pipe is connected to an inlet of said water distributing unit, a first outlet of said water distributing unit is connected to said handshower, and the other water conveying device connects a second outlet of said water distributing unit to said showerhead.

Still a further feature of the system for showering is that it can also have a water distributing unit, an elongated extension pipe having two ends, a handshower, and a second such water conveying device, wherein one of said water conveying devices is arranged to turnably connect one end of said extension pipe to the water supplying pipe, the other end of said extension pipe is connected with an inlet of said water distributing unit, said handshower is connected to a first outlet of said water distributing unit, and. the other water conveying device turnably connects said showerhead to a second outlet of said water distributing unit.

In accordance with another feature of the present invention the system of showering of the invention can also have a spacer arranged to extend between said extension pipe and a wall to adjust a spacing of said extension pipe from the wall and its angular position relative to the wall, and to provide a support for the extension pipe.

The spacer of the inventive system can have one end abuttable against the wall and another opposite end engageable with said extension pipe and slidable along said extension pipe so that said spacer can be arranged in a plurality of positions spaced from one another in a vertical direction. The spacer can have a main part and a fork-shaped attachment which forms said opposite end of said spacer, wherein said fork-shaped attachment is turnably connected to said main part and has two prongs which receive said extension arm therebetween.

In accordance with a further feature of the present invention, the extension pipe has a support which holds a handshower and is arranged slidingly along said extension arm. The support can be fork-shaped and can have two prongs which receive said handshower therebetween.

In accordance with a further feature the inventive system can have two water distributing devices, an elongated extension pipe having two ends, a handshower, and a second such water conveying device, wherein one of said water distributing devices has an inlet connectable to the water supplying pipe and a first outlet connected with said showerhead, one end of said extension pipe is turnably connected to second outlet of the other water distributing device, another end of said extension pipe is connected to an inlet of the other water distributing device, a first outlet of said second water distributing device is connected with a first outlet of the other water distributing device, and a second outlet of the other water conveying device is turnably connected to said showerhead.

The novel features of the present invention are set forth in particular in the appended claims. The invention itself, however, both as to its construction and its operation, will be best understood from the following description of the preferred embodiments which is accompanied by the following drawings.

DESCRIPTION OF THE PREFERRED EMBODIMENTS

Figure 1A:
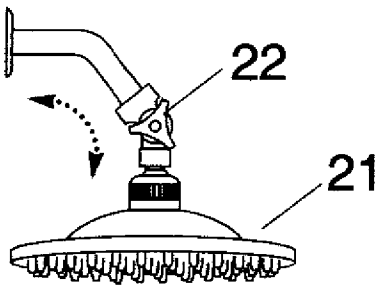
FIGS. 1 and 1*a* are view showing a first embodiment of a system for showering in accordance with the present invention.

A system of showering in accordance with the present invention has at least one showerhead identified with reference numeral 21 and a water conveying device which is identified with reference numeral 22 and turnably connects the showerhead 21 to a water supplying pipe 23.

The water conveying device 22 has two water conveying members. The first water conveying member is identified with reference numeral 1. It has a first opening 2 forming an inlet and having a first axis A-A, a channel 3 extending from the first opening 2, and a through hole 4 extending from the channel 3 along a turning axis B-B. The opening 2 is used for insertion of one end of the water supplying pipe 23-and is provided with first connecting means formed as an inner thread (female thread) engageable with an outer thread (male thread) of the end of the water supplying pipe 23 when the one end of the latter is inserted into the opening 2.

The second conveying member is identified with reference numeral 5. It has a second opening 6 forming an outlet and having a second axis C-C, a channel 7 extending from the second opening 6, and a through hole 8 extending from the channel 7 along the turning axis B-B. A part of the second water conveying member, In which the second opening 6 is formed, is provided with connecting means formed as an outer thread (male thread) engageable within inner thread (female thread) of the end of the showerhead 21 when the other end of the latter is pushed onto the threaded part of the second water conveying member.

The first water conveying member 1 has a portion with a concave surface 9, while the second water conveying member has a portion with a convex surface 10 congruent with the concave surface 9, so that when the first and second water conveying member 1 and 5 are assembled with one another and turn relative to one another the surfaces 9 and 10 are slidable over one another, preferably with a sliding contact.

In order to assemble the first and second water conveying members with one another, they are first brought into a contact with each other so that axes of their holes 4 and 8 coincide with one another and with the turning axis B-B, and then connecting elements connect them with each other. In this position the axes A-A and C-C of the first and second water conveying members 1 and 5 coincide with one another and form a continuation of each other. A first connecting element 11 is formed for example as a threaded bolt and inserted into the aligned holes 4 and 8 of the water conveying members so that its head is located in a part 12 of the hole 4, and a second connecting element 13 is formed for example as a nut and is introduced into a part 14 of the hole 8, to be screwed onto a threaded portion of the treaded bolt.

In the water conveying device a first seal 15 is provided between the first connecting member or the treaded bolt 11 and the first water conveying member 1, a second seal 16 is provided between the water conveying members 1 and 5, and a third seal 17 is provided between the second connecting member or the nut 13 and the second water conveying member 5.

When for example the second water conveying member 5 is turned relative to the first water conveying member 1 to provide a desired angle between them and thereby a desired orientation of the outlet opening 6 relative to the inlet opening 2 and thus a desired orientation of the showerhead 21 relative to the water conveying pipe 23, and when the nut 13 in the water conveying device is tightened on the bolt 11, the first and second water conveying members are locked relative to one another in a desired angular position and all seals are compressed and immovably retained in their respective receiving openings with full water-tightness and the first and second conveying members are fixed in their relative position. In this embodiment the showerhead is angle adjustable, fixable in desired angular positions and sealed at the same time.

Figure 1:
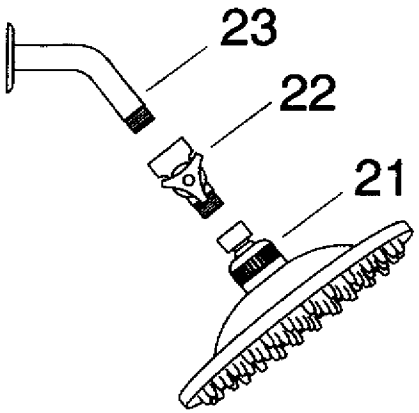
Figure 4:
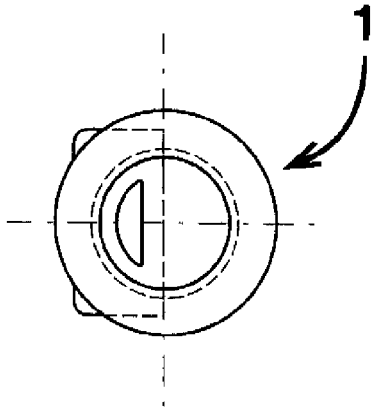
FIGS. 2,3 and 4 are views showing a side view, a cross section and a top view of a first water conveying member of a water conveying device of the inventive system for showering.
Figure 3:
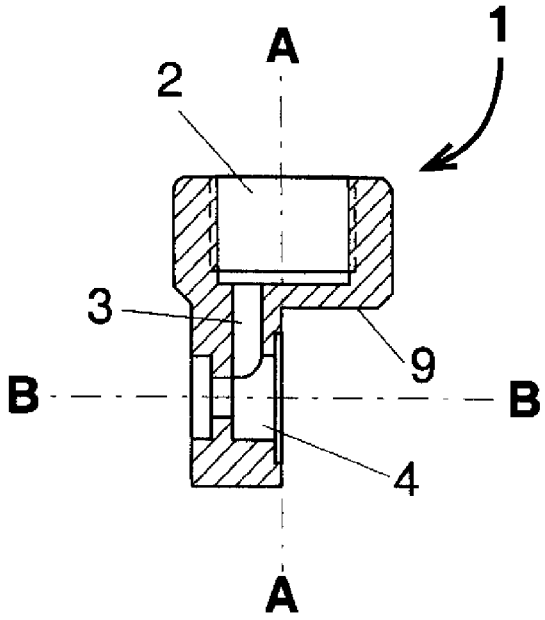
Figure 2:
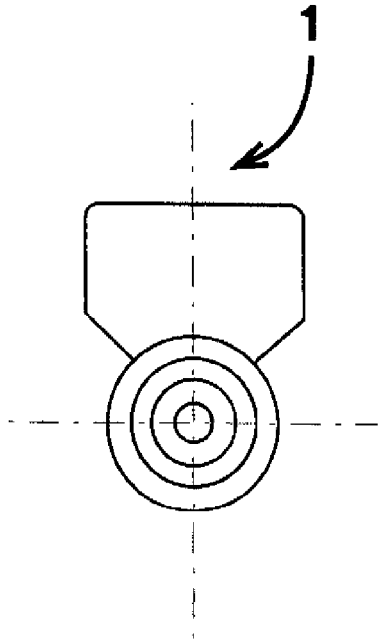
Figure 7:
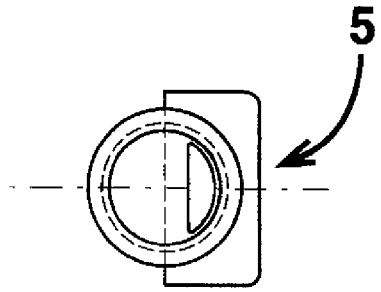
FIGS. 5,6 and 7 are views showing a side view, a cross section and a bottom view of a second water member of the water conveying device of the inventive system for showering.
Figure 6:
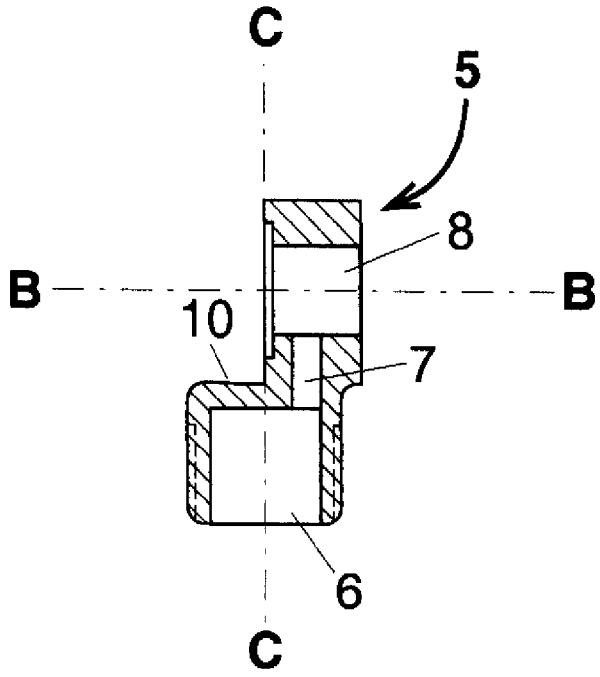
Figure 5:
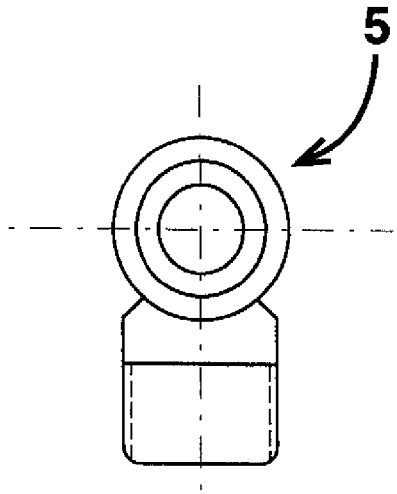
Figure 9:
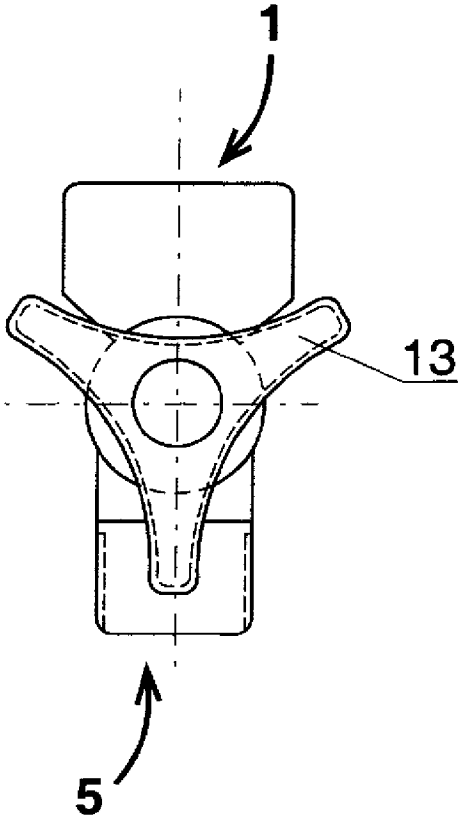
FIGS. 8 and 9 are views showing a cross section and a side view of the water conveying device of the inventive system for showering.
Figure 8:
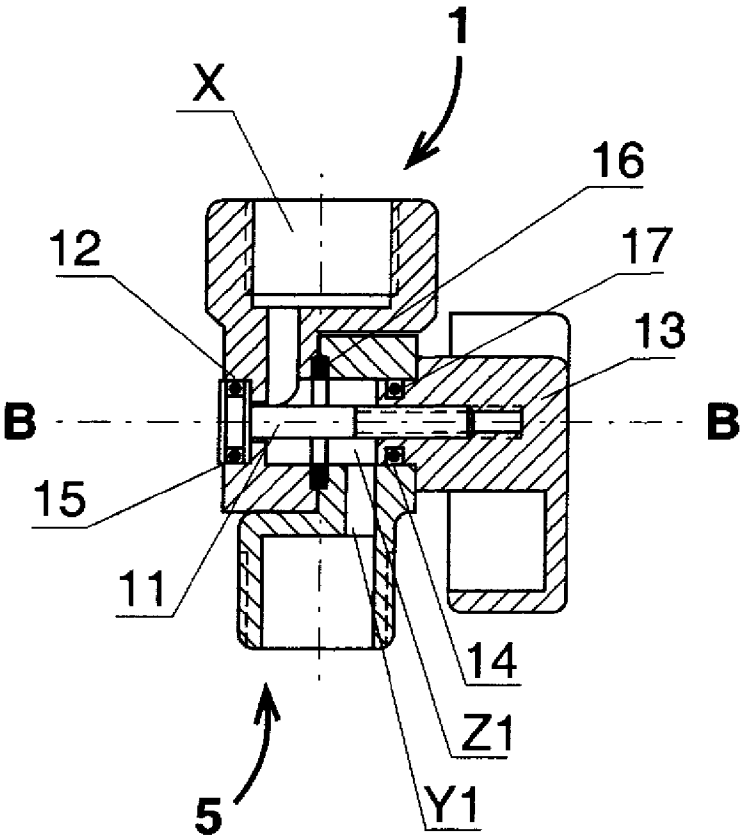
Figure 10A:
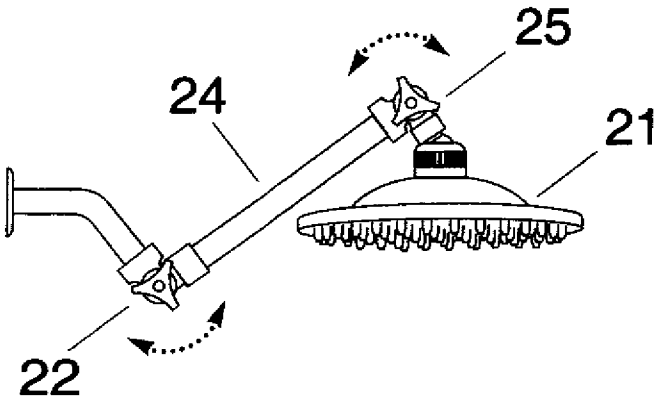
FIGS. 10 and 10*a* are views showing the system for showering in accordance with a further embodiment of the present invention.
Figure 10:
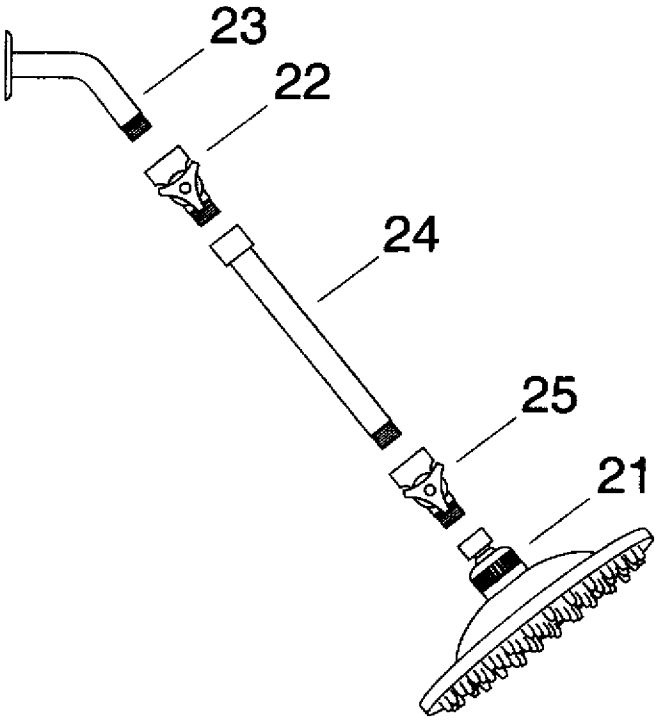

While in the embodiment shown in FIGS. 1 and 1*a* the system for showering has one water conveying device 22 and allows easy turning of the overhead showerhead 21 relative to the water supplying pipe 23, the system for showering shown in FIGS. 10, 10*a* has additionally an elongated extension pipe 24 and a second water conveying device 25 which is similar to the water conveying device 22. The water conveying members of both water conveying devices are turnable about horizontal axes. In this system the first water conveying member of the first water conveying device 22 is connected to the water supplying pipe 23, the second water conveying member of the first water conveying device 22 is connected to the first end of the extension pipe 24, the second end of the extension pipe is connected with the first water conveying member of the second water conveying device 25, and the second water conveying member of the second water conveying device is connected to the showerhead 21.

In the system for water showering shown in FIGS. 10 and 10*a* therefore the ends of the extension pipe 24 are connected turnably about horizontal axes to the water supplying pipe 23 and to the showerhead 21 correspondingly. It is possible to raise and lower the showerhead and to adjust its angle, making the showerhead both height and angle adjustable.

Figure 11A:
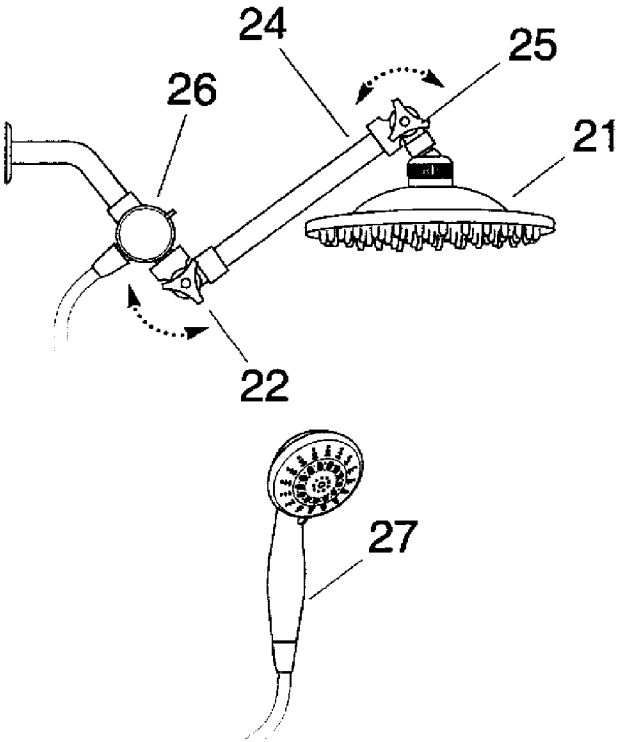
FIGS. 11 and 11*a* are views showing a system for showering in accordance with still a further embodiment of the present invention.
Figure 11:
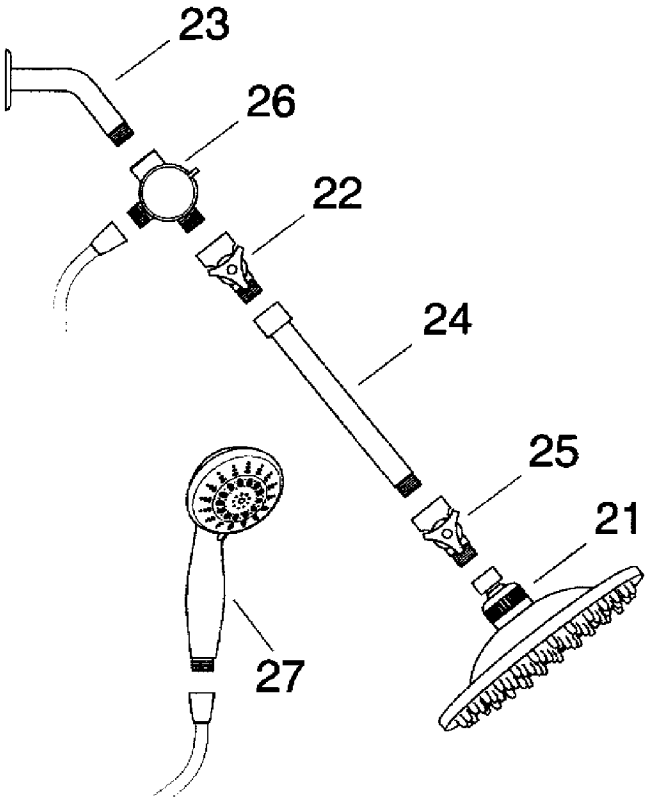

In the system of showering shown in FIGS. 11 and 11*a*, additionally a water distributing unit 26 and a handshower 27 are provided. In this system an inlet of the water distributing unit 26 is connected with the water supplying pipe 23, while its outlets are connected to the handshower 27 and first water conveying member of the water conveying device 22, the second water conveying member of the water conveying device 22 is connected to one end of the extension pipe 24, the other end of the connection pipe 24 is connected to the first conveying member of the second water conveying device 25, and the second water conveying member of the second water conveying device 25 is connected to the showerhead 21.

In the system for showering shown in FIGS. 11 and 11*a* the showerhead 21 is turnably connected to the extension pipe 24, and the extension pipe 24 is turnably connected to the water distributing device 26 and thereby to the water supplying pipe 23. In this system a user can use two showering components, namely the showerhead 21 and the handshower 27 separately or simultaneously by an operating knob. The user can also raise or lower the showerhead 21 and adjust its angle, making it both height and angle adjustable. The turning axes of the devices 22 and 25 are also horizontal.

Figure 12A:
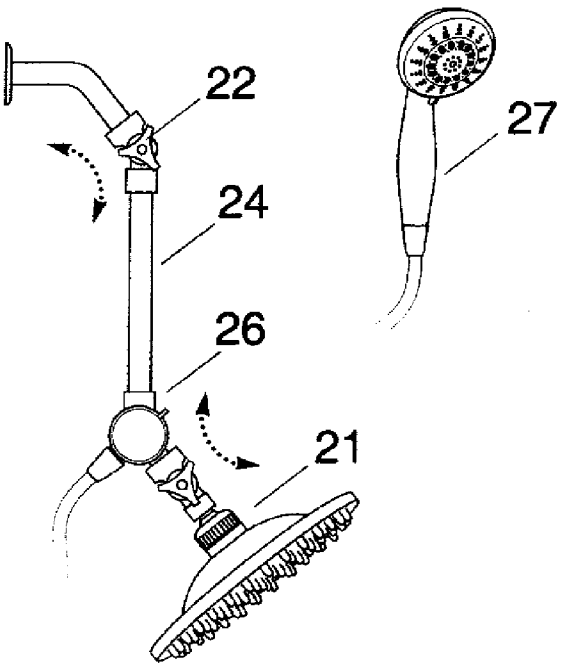
FIGS. 12 and 12*a* are views showing a system for showering in accordance with an additional embodiment of the present invention.
Figure 12:
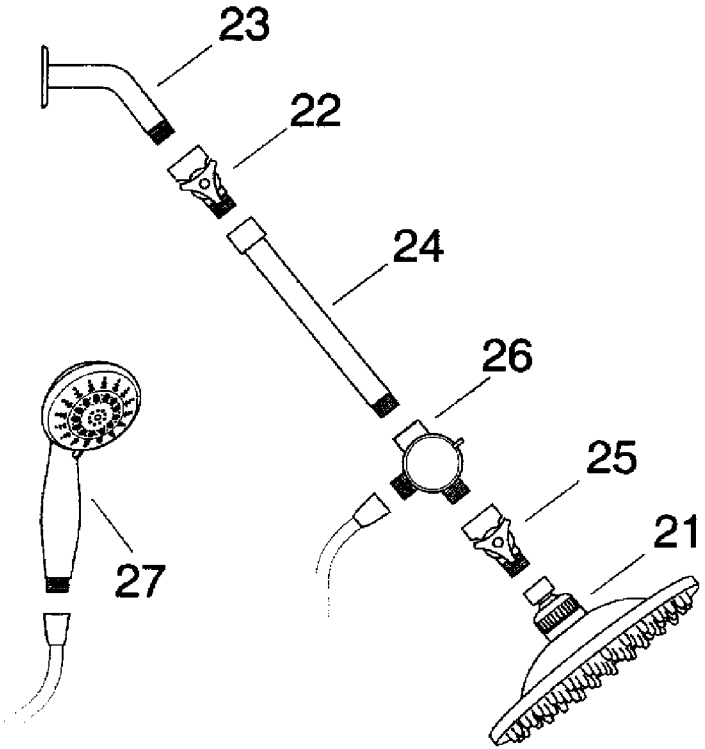

In the system for showering shown in FIGS. 12 and 12*a* one end of the water extension pipe 24 is turnably connected to the water supplying pipe 24 through the first water conveying device 22, the other end of the extension pipe 24 is connected with the inlet of the water distributing device 26, the outlets of the water distributing unit 26 are connected with the first water conveying member of the second water conveying device 25 and with the handshower 27 correspondingly, and the second water conveying member of the second water conveying device 25 is connected to the showerhead 21.

In the system shown in FIGS. 12 and 12*a* the showerhead 21 is turnably connected to the extension arm 24, and the extension arm 24 is turnably connected to the water supplying pipe 23. This system provides a user with easier reach and operation of the water diverting unit 26 and the handshower 27. The turning axes of the devices 22 and 25 are all horizontal.

Figure 13A:
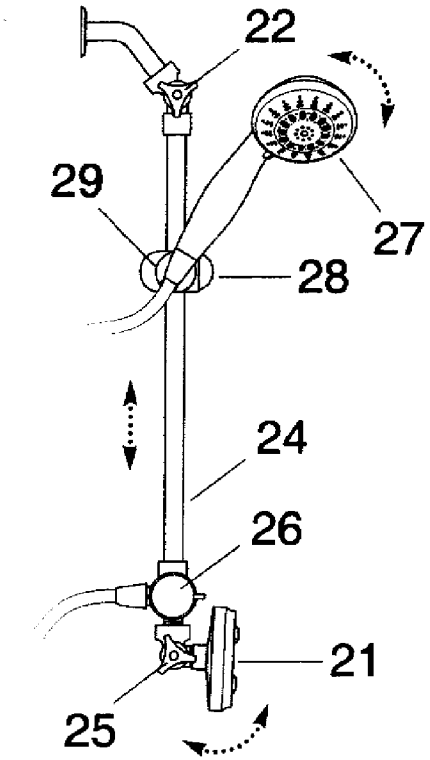
FIGS. 13 and 13*a* are*views showing the system for showering in accordance with another embodiment of the present invention.
Figure 13:
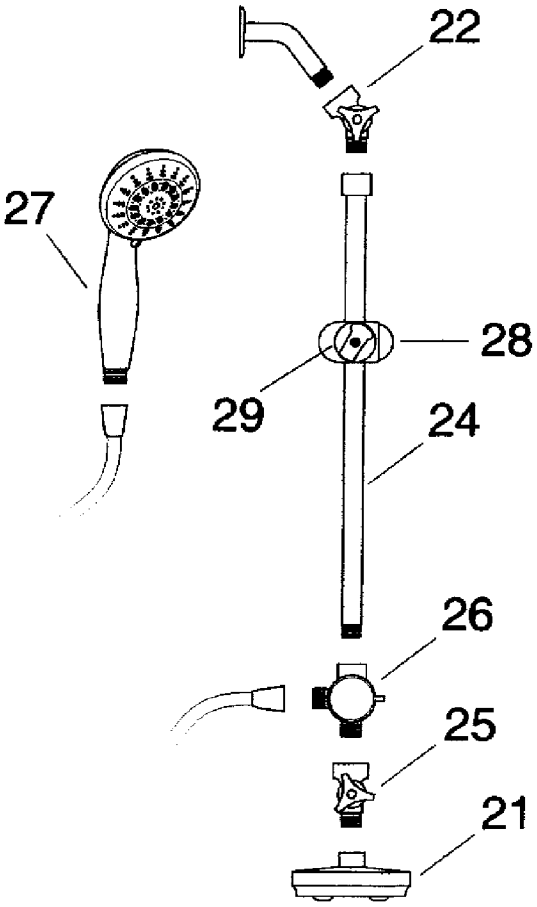

The system for showering shown in FIGS. 13 and 13*a* includes all components of the system for showering shown in FIGS. 12 and 12*a*. In addition, it also has a support which is identified with reference numeral 28 and is arranged on the extension pipe 24, preferably slidingly along the latter. The support 28 has two prongs 29 which are spaced from one another so that a handshower 27 can be received in a space between the prongs and held on the support. The prongs of the support also can be turnable about an axis of the latter to assume various angular positions. The turning axes of the devices 22 and 25 are all horizontal.

Figure 14A:
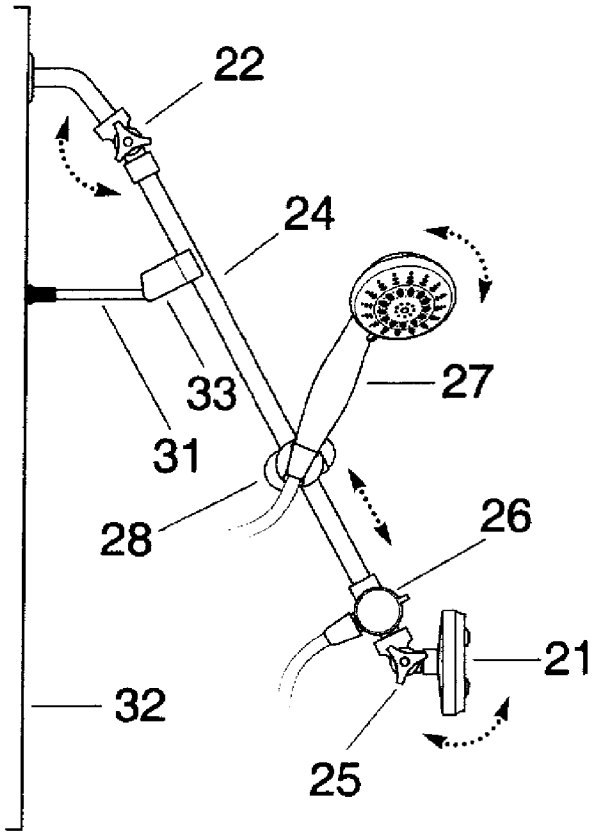
FIGS. 14 and 14*a* are views showing a system for showering in accordance with a further embodiment of the present invention.
Figure 14:
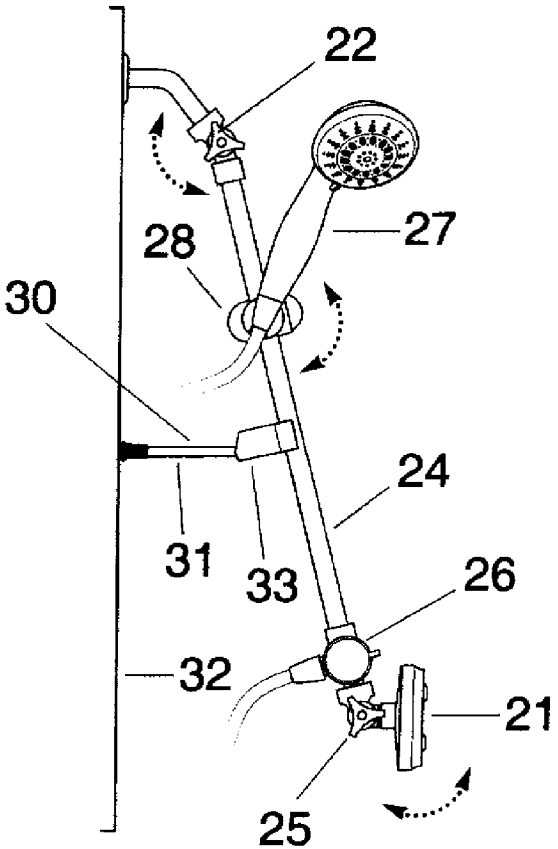

In this system the extension arm has a quadruple function; first as an extension, second as a water supplying element to the water diverting unit 26, third as a holder for the support 28, and fourth as a slide rail for moving the handshower 27 up and down. The handshower 27 can move up and down along the extension arm 24 to a desired height, and the turnable support allows to adjust its angular position. The upper water conveying, device allows to tilt the extension arm 24 towards a wall or towards a user for easy reach and control, and also the water diverting unit 26 with the showerhead 21 and the lower water conveying device 25 can be moved closer to the user with the angle of the showerhead 21 adjusted accordingly A system for showering shown in FIGS. 14 and 14*a* includes all components shown in FIGS. 12 and 12*a*. In addition it also has a spacer which is identified with reference numeral 30. The spacer 30 has a main part 31 with one end abutting against a wall 32, and another end formed by a fork-shaped attachment 33 connected to the main part 31. The attachment 33 has two prongs with a space therebetween, in which a portion of the extension pipe 24 is received. The spacer 30 can be moved upwardly and downwardly to support the extension pipe 24 at corresponding different angles relative to the wall.

Figure 15A:
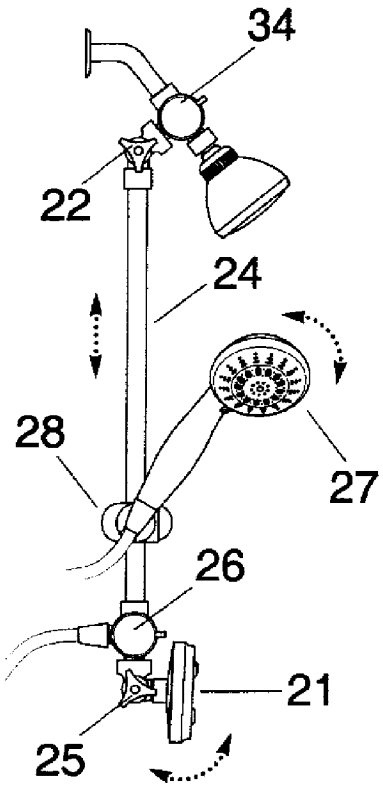
FIGS. 15 and 15*a* are views showing the system for showering in accordance with still a further embodiment of the invention.
Figure 15:
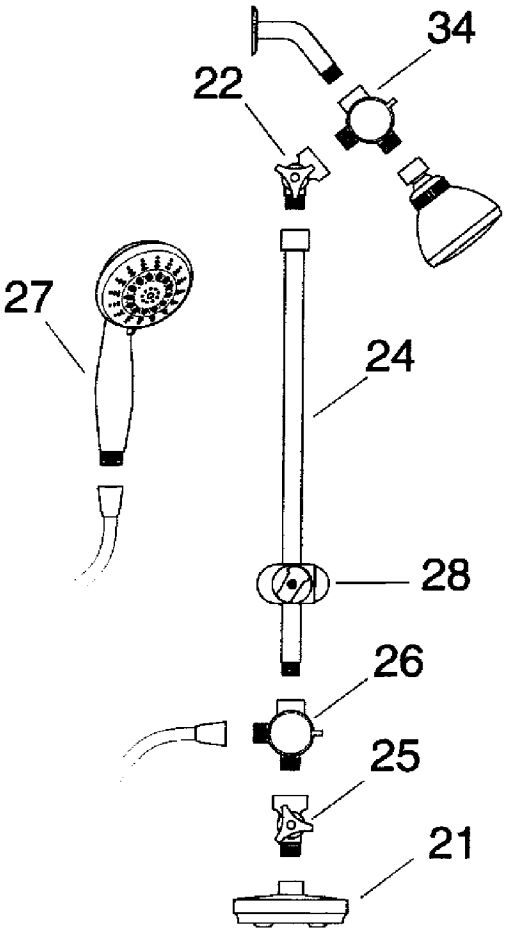

A system for showering shown in FIGS. 15 and 15*a* is substantially similar to the system for showering shown in FIGS. 13 and 13*a* and in addition it has a second water distributing device 34 arranged so that its inlet is connected with the water supplying pipe 23 while its outlets are connected with the first water conveying member of the water conveying device 22 and the showerhead 21 correspondingly. If desired, this system can be also provided with the spacer 30 of FIGS. 14 and 14*a*.

In each of the systems described hereinabove, the knob 13 of the conveying member 22 performs a dual function, namely: it locks an angular position of any element attached to its second water conveying member, and at the same time it seals the first and second water conveying members from leakage by compressing the sealing members 12, 16 and 17.

It should be emphasized that the present invention is not limited to the details shown, since various modifications and structural changes are possible without departing in any way from the spirit of the invention.

What is desired to be protected by Letters Patent is set forth in particular in the appended claims.

The invention claimed is:

1. A system for showering, comprising at least one handshower communicatable with a water supplying pipe and receiving water from the latter; at least one elongated extension arm turnably connectable with the water supplying pipe, said elongated extension arm having one end communicatable with the water supplying pipe and supplying water in a direction of elongation of said elongated extension arm and another end issuing the water from the water supplying pipe; a device turnably connecting said elongated extension arm with the water supplying pipe and supplying water from the water supplying pipe into said elongated extension arm; and a support constructed for holding said handshower and arranged on said elongated extension arm movable along the latter in the direction of elongation and thereby moving said handshower held on said support along said elongated extension arm in the direction of its elongation; a showerhead; a water distributing unit constructed for distributing water between said showerhead and said handshower; wherein said device includes first and second water conveying members assembled with each other so that they are turnable relative to one another about a turning axis between a plurality of angular positions relative to one another, wherein said first water conveying member has a first opening for water entry and said second water conveying member has a second opening for water exit formed so that in an assembled position of said first and second water conveying members said first and said second openings of said first and second wafer conveying members extend transversely to said turning axis and are coaxial with each other; wherein one of said water conveying members is connectable to the water supplying pipe, while the other of said water conveying members is connected with said one end of said elongated extension arm.

2. A system for showering as defined in claim 1, further comprising a second such device having said first and second water conveying members turnable relative to one another, wherein one of said water conveying members of said second device is turnably connected with the other end of said elongated extension arm, while the other of said water conveying members of said second water conveying device communicates with said showerhead.

3. A system for showering as defined in claim 1, wherein said water distributing unit having an inlet connected with said other end of said elongated extension arm, a first outlet connected with said handshower, and a second outlet connected with said showerhead.

4. A system for showering as defined in claim 1, wherein said support is fork-shaped and has two prongs turnable about an axis of the latter and spaced from one another to form a space in which said handshower is received.

5. A system for showering as defined in claim 1, further comprising a spacer arranged to extend between said elongated extension arm and a wall to provide support and adjust a spacing of said extension arm from the wall, said spacer having one end abuttable against the wall and another opposite end engageable with and slidable along said elongated extension arm.

6. A system for showering as defined in claim 5, wherein said spacer has a main part and a fork-shaped part which forms said opposite end, is turnably connected to said main part and has two prongs for receiving said elongated extension arm therebetween.

7. A system for showering as defined in claim 1, wherein said handshower is connected with said second end of said elongated extension arm.

8. A system for showering as defined in claim 1, wherein said water distributing unit is connected with said second end of said elongated extension arm.

9. A system for showering as defined in claim 1, further comprising a second water distributing unit locatable between the water supplying pipe and said device.

* * * * *